US010665972B2

(12) United States Patent
Russo et al.

(10) Patent No.: US 10,665,972 B2
(45) Date of Patent: May 26, 2020

(54) PLUG CONNECTOR WITH SECONDARY SAFETY

(71) Applicant: Lumberg Connect GmbH, Schalksmühle (DE)

(72) Inventors: Paulo Russo, Dortmund (DE); Frank Rentrop, Lüdenscheid (DE); Dirk Pfaffenbach, Halver (DE); Olaf Steinbach, Schalksmuehle (DE)

(73) Assignee: Lumberg Connect GmbH, Schalksmuehle (DE)

( * ) Notice: Subject to any disclaimer, the term of this patent is extended or adjusted under 35 U.S.C. 154(b) by 0 days.

(21) Appl. No.: 16/218,571

(22) Filed: Dec. 13, 2018

(65) Prior Publication Data

US 2019/0229450 A1 Jul. 25, 2019

(30) Foreign Application Priority Data

Jan. 25, 2018 (DE) ..... 10 2018 101 667

(51) Int. Cl.
*H01R 12/70* (2011.01)
*H01R 4/2433* (2018.01)
(Continued)

(52) U.S. Cl.
CPC ..... *H01R 12/7023* (2013.01); *H01R 4/2433* (2013.01); *H01R 4/2445* (2013.01);
(Continued)

(58) Field of Classification Search
CPC H01R 12/7023; H01R 4/2433; H01R 4/2445; H01R 12/515; H01R 12/58;
(Continued)

(56) References Cited

U.S. PATENT DOCUMENTS 3,244,941 A * 4/1966 Maynard ..... H01H 50/048 361/636
3,675,185 A 7/1972 Ruehlemann et al.
(Continued)

FOREIGN PATENT DOCUMENTS

DE 10318980 A1 11/2004
DE 102004019032 A1 11/2005
(Continued)

*Primary Examiner* — Travis S Chambers
(74) *Attorney, Agent, or Firm* — Von Rohrscheidt Patent

(57) ABSTRACT

The invention relates to a plug connector, in particular a direct plug connector, for contacting contact openings of a circuit board, the plug connector including a contact carrier which can include coding devices, in particular coding pins and a polarity reversal safety, in particular configured as polarity protrusions; conductor insertion channels formed by the contact carrier and configured to receive connection conductors, and contact recesses configured to receive plug contacts; a primary safety that supports the contact carrier at the circuit board and that is in particular configured as interlocking elements, characterized in that, the contact carrier is provided with a secondary safety which fixes the contact carrier at the circuit board in addition to the primary safety and which is operable independently from the primary safety.

8 Claims, 16 Drawing Sheets

(51) Int. Cl.

| | |
|---|---|
| ***H01R 12/51*** | (2011.01) |
| ***H01R 13/621*** | (2006.01) |
| ***H01R 4/2445*** | (2018.01) |
| ***H01R 12/58*** | (2011.01) |
| ***H01R 12/71*** | (2011.01) |

(52) U.S. Cl.
CPC ..... *H01R 12/515* (2013.01); *H01R 12/58* (2013.01); *H01R 12/7047* (2013.01); *H01R 12/716* (2013.01); *H01R 13/621* (2013.01); *H01R 12/7052* (2013.01)

(58) Field of Classification Search
CPC ..... H01R 12/7047; H01R 12/716; H01R 13/621; H01R 12/7052
USPC ..... 439/567, 557, 564, 573
See application file for complete search history.

(56) References Cited

U.S. PATENT DOCUMENTS 4,435,031 A * 3/1984 Black ..... H01R 12/7029 174/138 D
4,827,609 A * 5/1989 Kawecki ..... F16B 21/02 29/462
6,162,090 A * 12/2000 Klubenspies ..... H01R 12/7058 439/564
6,257,925 B1 * 7/2001 Jones ..... H01R 13/6273 439/357
6,418,035 B1 * 7/2002 Yu ..... H01R 12/7047 361/809
7,658,643 B2 * 2/2010 Tuerschmann .... H01R 12/7047 439/564
10,535,950 B2 * 1/2020 Russo ..... H01R 12/7052
2002/0142643 A1 * 10/2002 Quinn ..... H01R 9/2491 439/553
2003/0224654 A1 * 12/2003 Wu ..... H01R 12/7047 439/573
2008/0318452 A1 12/2008 Lin
2019/0229464 A1 * 7/2019 Russo ..... H01R 4/2433

FOREIGN PATENT DOCUMENTS

DE 202009018730 U1 11/2012
DE 202016105358 U1 1/2018
DE 202016105525 U1 1/2018

* cited by examiner

PLUG CONNECTOR WITH SECONDARY SAFETY

RELATED APPLICATIONS

This application claims priority from and incorporates by reference German patent application 10 2018 101 667.0, filed on Jan. 25, 2018.

FIELD OF THE INVENTION

The invention relates to a plug connector.

BACKGROUND OF THE INVENTION

Plug connectors of this generic type, in particular for contacting a connection conductor at a circuit board using a plug-in contact, are well known in the art. Direct plug connectors are plug connectors whose contacts directly contact conductor sections of circuit boards. The direct plug connectors are provided with plug contacts for specially shaped circuit boards. The circuit boards include cutouts for this purpose wherein inner circumferential surfaces of the cutouts are provided with an electrically conductive layer. The contact fingers of the plug contacts contact the conductive layer of the circuit board directly.

Plug connectors of this generic type are known that include a primary safety in order to fix the contact carrier at the circuit board and to protect the contact carrier against unintentional disengagement from the circuit board, e.g., by tension forces which are applied by the connection conductors. The primary safety also fixes the plug connector at the circuit board when vibrations occur. This provides reliable and permanent contacting.

The primary safety includes interlocking elements. The interlocking elements are arranged at the contact carrier and cooperate with cutouts in the circuit board in order to fix the contact carrier at the circuit board. Thus, interlocking devices that are configured by the interlocking elements reach under the circuit board on a bottom side of the circuit board that is oriented away from the plug connector.

Plug connectors are going through a miniaturization process. The requirements with respect to securing the plug connectors at the circuit board thus remain at least constant.

BRIEF SUMMARY OF THE INVENTION

Thus, it is an object of the invention to provide a plug connector whose configuration facilitates a reliable arrangement at the circuit board.

The object is achieved by a plug connector, in particular a direct plug connector, for contacting contact openings of a circuit board, the plug connector including a contact carrier which can include coding devices, in particular coding pins and a polarity reversal safety, in particular configured as polarity protrusions; conductor insertion channels formed by the contact carrier and configured to receive connection conductors, and contact recesses configured to receive plug contacts; a primary safety that supports the contact carrier at the circuit board and that is in particular configured as interlocking elements, characterized in that, the contact carrier is provided with a secondary safety which fixes the contact carrier at the circuit board in addition to the primary safety and which is operable independently from the primary safety.

It is an essential advantage of the invention that the plug connector includes a secondary safety. The secondary safety fixes the contact carrier at the circuit board in addition to the primary safety, wherein there is no operational dependency between the primary safety and the secondary safety. Thus, it is possible to safely attach the contact carrier at the circuit board when a primary safety fails or is lost.

The secondary safety provides in particular that the plug connector absorbs higher tension forces than would be transferable by the primary safety itself. The retention forces of the primary and secondary safety add up at least partially.

It is also advantageous to provide the secondary safety only in cases where additional retaining forces are required in order to secure the plug connector at the circuit board.

It is initially provided that the secondary safety is a locking pin that is separately mountable at the contact carrier.

It is particularly advantageous that the locking pin is pre-interlocked at the contact carrier in a mounting position and terminally interlocked at the circuit board in a function position in which the locking pin fixes the contact carrier at the circuit board.

Due to the pre-interlocking of the locking pin in the contact carrier a possible loss or damage of the locking pin, e.g., when transporting the plug connector, are avoided.

It is provided in particular that the locking pin is provided with a first interlocking geometry which is used for preassembly and a second interlocking geometry that cooperates with the circuit board in order to fix the contact carrier.

It is furthermore provided that the locking pin is moveable into a locking position and into an unlocking position, wherein the locking pin fixes the contact carrier at the circuit board in the locking position and wherein the fixing effect of the locking pin is discontinued in the unlocking position.

Eventually it is provided that the locking pin is rotatably arranged in a bore hole that extends through the contact carrier and that is parallel to the plug-in direction.

It is furthermore provided that the second interlocking geometry envelopes the outer circumference of the locking pin at least partially and that the second interlocking geometry includes two diametrically opposed interlocking protrusions. When the locking pin is rotatably supported in the contact carrier, this interlocking geometry in combination with suitable cutouts of the printed circuit board facilitates disengaging the initial interlocking.

It is also conceivable that the interlocking protrusions are configured as threaded sections. The threaded sections facilitate clamping the contact carrier and the circuit board together when the locking pin is rotatably supported.

In a particularly advantageous embodiment the locking pin facilitates a retaining force of up to 72 Newton.

The locking pin can include a tool engagement feature, e.g., a groove. Thus the locking pin can be rotated by a tool, e.g. a screwdriver, in the bore hole. Thus, it is provided that a 90° rotation moves the locking pin from its interlocking position into its unlocking position.

BRIEF DESCRIPTION OF THE DRAWINGS

The invention is now described based on advantageous embodiments with reference to drawing figures, wherein.

DETAILED DESCRIPTION OF THE INVENTION

Figure 1:
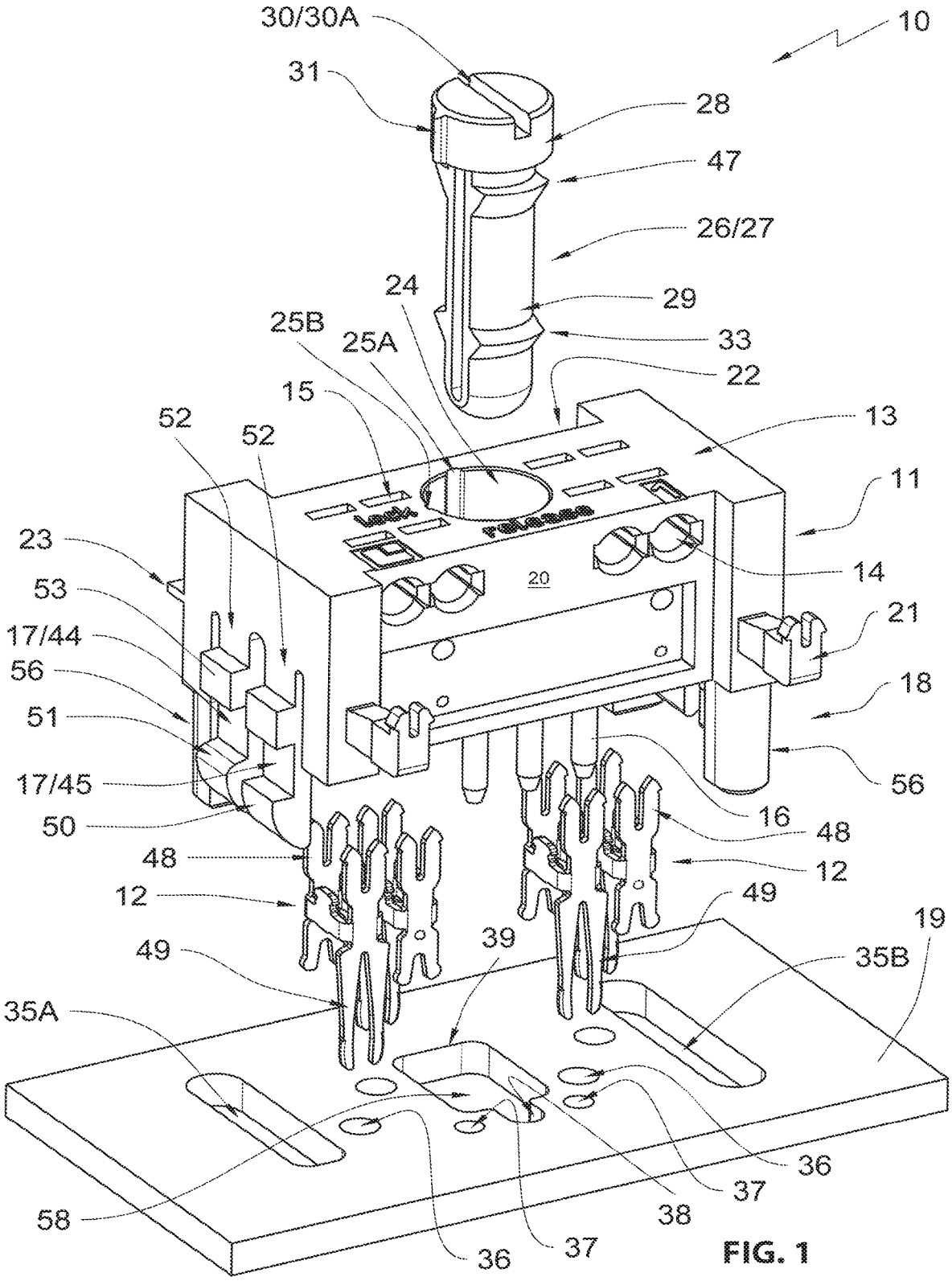
FIG. 1 illustrates an exploded view of a first embodiment of a plug connector according to the invention with a secondary safety configured as a locking pin and with a printed circuit board.

The drawing figures illustrate a plug connector according to the invention that is designated overall with the reference numeral 10.

FIGS. 1 through 14 disclose the first embodiment of the plug connector 10. A second embodiment is illustrated in FIGS. 15 through 18. Identical or like components are designated with identical reference numerals. Unless stated otherwise, descriptions regarding one embodiment apply accordingly to the alternative embodiments.

FIG. 1 illustrates a circuit board 19 in addition to the plug connector 10 with the contact carrier 11 and the secondary safety 26.

The plug connector 10 includes the contact carrier 11 which forms a housing 13 for plug contacts 12. The housing 13 of the contact carrier 11 is provided with conductor insert channels 14 that are configured to receive non-illustrated connecting conductors. The connecting conductors are electrically connected by cutting edge clamping forks 48 with the plug contacts 12, The plug contacts 12 form the contact fingers 49 which reach below the contact opening 36 of a circuit board 19 as soon as the plug connector 10 is arranged at the circuit board 19 as illustrated, e.g., in FIG. 11.

Furthermore, the housing 13 is configured with contact recesses 15 into which the plug contacts 12 are inserted. The housing 13 supports several coding pins 16 at its outer surface, wherein the coding pins protrude from the plug connector 10 in the plug in direction and associate the plug connector 10 at the circuit board 19 that has a corresponding encoding, in particular configured as coding boreholes 37.

The housing 13 includes interlocking hooks 21 at its front side 20 wherein plural plug connectors 10 can be arranged at each other by the interlocking hooks for assembly purposes. On the back side 22 of the contact carrier 11 the housing 13 forms contours 23 to receive interlocking hooks 21 by which additional plug connectors 10 are arrangeable at the contact carrier 11.

Furthermore, the contact carrier 11 is provided with a polarity safety 18. The polarity safety 18 shall prevent a potentially short circuit generating contacting of the plug contact 12 with the contact openings 36 of the circuit board 19, The polarity safety 18 is formed by three polarity protrusions 56 that originate from the bottom side of the contact carrier 11 as illustrated, e.g., in FIG. 6. Thus, two of the polarity protrusions 56 are formed at the contact carrier 11 on a right side with respect to the paper plane, whereas only one polarity protrusion 56 is configured on the left side of the paper plane.

The housing 13 of the contact carrier 11 is penetrated by a borehole 24 parallel to the plug in direction. This borehole 24 includes a first notch 25A and a second notch 25B. The second notch 25B is an optional and non-mandatory feature of the borehole 24.

The borehole 24 is configured to receive the secondary safety 26, in particular configured as a locking pin 27, The locking pin 27 includes a head portion 28 and a pin-shaped base portion 29.

Figure 2A:
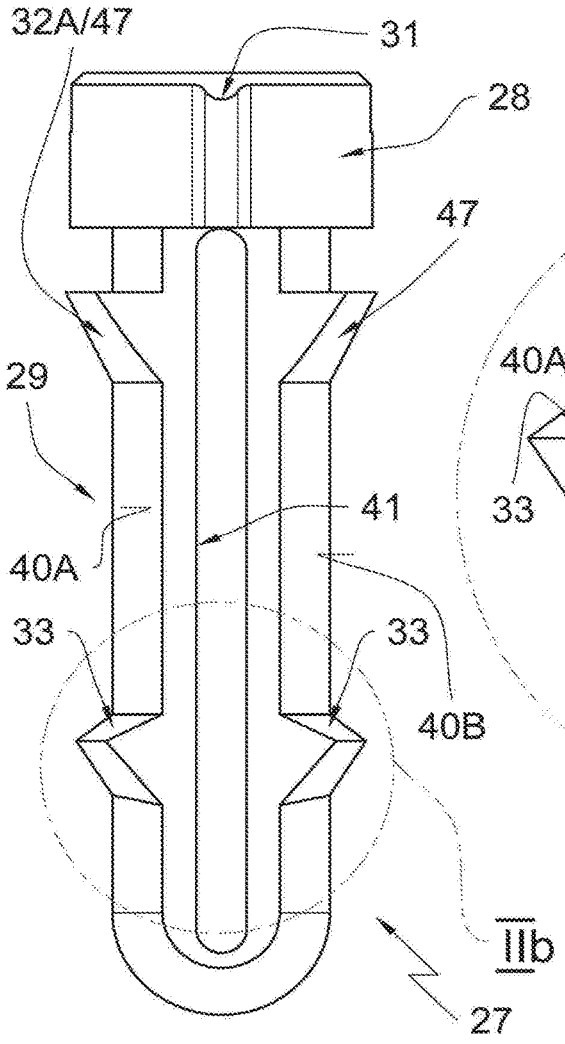
FIG. 2A illustrates a side view of the locking pin according to FIG. 1.

FIG. 2*a* illustrates the locking pin 27 in a side view. The outer circumference of the pin-shaped base portion 29 of the locking pin 27 is partially enveloped by assembly interlocking protrusions 47 and locking bar protrusions 33. The assembly interlocking protrusions 47 are configured to facilitate reassembly of the locking pin 27 at the contact carrier 11, The locking bar protrusions 33 reach under the circuit board 19 and support the plug connector 10 at the circuit board 19.

Figure 2B:
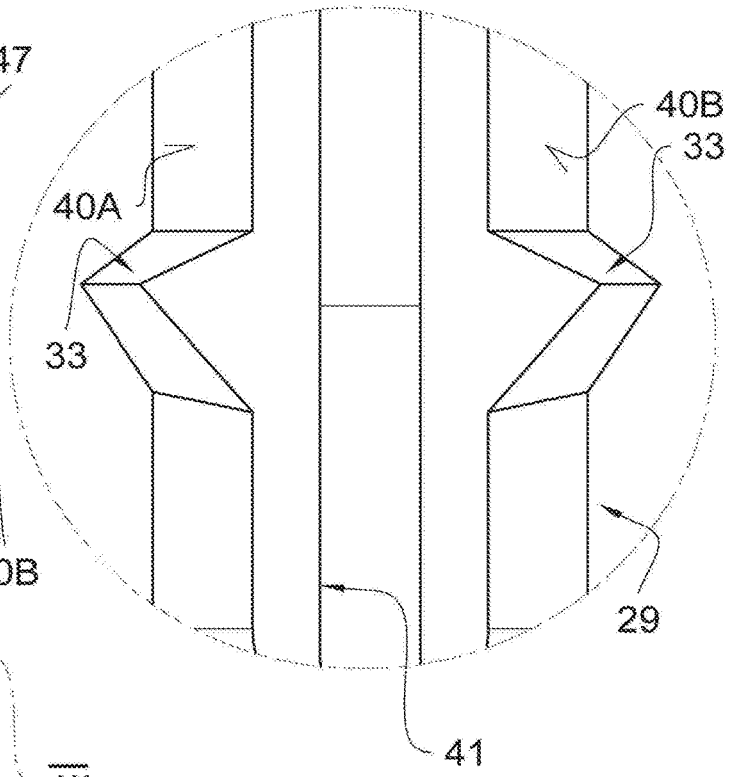
FIG. 2B illustrates a blown-up detail according to the detail circle IIB in FIG. 2A with a view of the interlocking protrusions of the locking pin.

The locking bar protrusions 33, which are illustrated in FIG. 2*b* in an enlarged view, are configured as threaded sections and are used for clamping the contact carrier 11 at the circuit board 19. Simultaneously the thread pitch also facilitates compensating for circuit board tolerances.

The pin-shaped base element 29 of the locking pin 27 includes a slot 41 that is defined by a first side wall 40A and a second side wall 40B. The slot 41 facilitates a diameter reducing rearward displacement of the side walls 40A and 40B which support the locking bar protrusions 33.

The head portion 28 shows the rib 31. The rib 31 cooperates with the first notch 25A or the second notch 25B of the borehole 24 (c.f., FIG. 1, FIG. 5). This rib 31 cooperates as a function of the locking position of the locking pin 27 with the first notch 25A or the second notch 25B and thus supports the locking pin 27 or its locking protrusions 33 in the locking position or unlocking position of the secondary safety 26.

Figure 3:
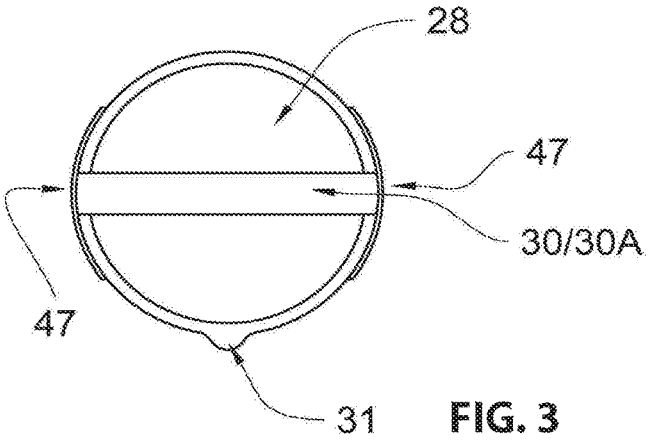
FIG. 3 illustrates a top view of the head element of the locking pin according to FIG. 2A with a tool engagement feature.

The rib 31 and the head portion 28 of the locking pin 27 are illustrated in FIG. 3. The head portion 28 forms a groove 30A which facilitates receiving a non-illustrated tool and thus displaces the locking pin into the locking position or unlocking position. A screwdriver can be inserted, e.g., into the groove 30A wherein the screwdriver facilitates rotating the locking pin 27 in the borehole 24 by 90°.

Figure 4:
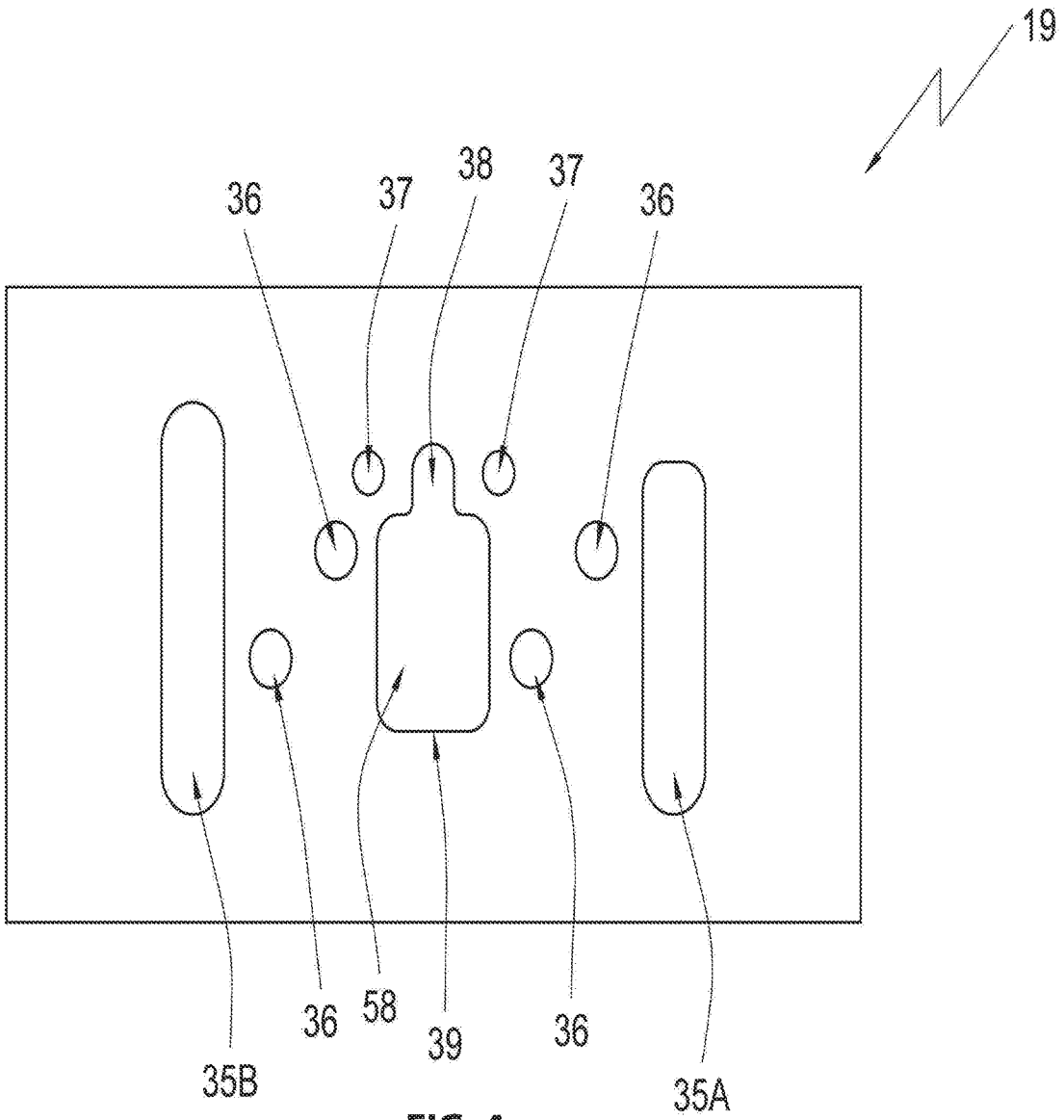
FIG. 4 illustrates a top view of a circuit board.

FIG. 4 illustrates the circuit board 19 from above. The circuit board 19 forms the contact openings 36 configured to receive the plug contacts 12 of the contact carrier 11. Furthermore, the circuit board 19 includes a cutout 39 with a keyhole contour formed in a center of the circuit board 19. This contour is divided into a stem section 58 and a web section 38. The stem section 58 is configured to receive the pin-shaped base portion 29 of the locking pin 27. The web section 38 is configured to receive a coding pin 16 of the contact carrier 11. Two coding boreholes 37 are configured in the circuit board 19 on both sides of the web section 38, wherein the two coding boreholes are configured to receive the remaining coding pins 16 of the contact carrier 11.

The circuit board 19 includes a first slotted hole 35A and a second slotted hole 35B adjacent to the pass-through opening 39. The slotted holes 35A and 35B include sections which cooperate on the one hand side with a primary safety 17 and on the other hand the polarity protrusions 56 of the polarity safety 18. The slotted hole 35A cooperates on the one hand side with the primary safety 17 and with a polarity protrusion 56, The slotted hole 35B cooperates with the primary safety 17 and with two polarity protrusions 56 and is accordingly configured longer than the slotted hole 35A. An incorrect position of the plug connector 10 at the circuit board 19 is therefore impossible.

Figure 5:
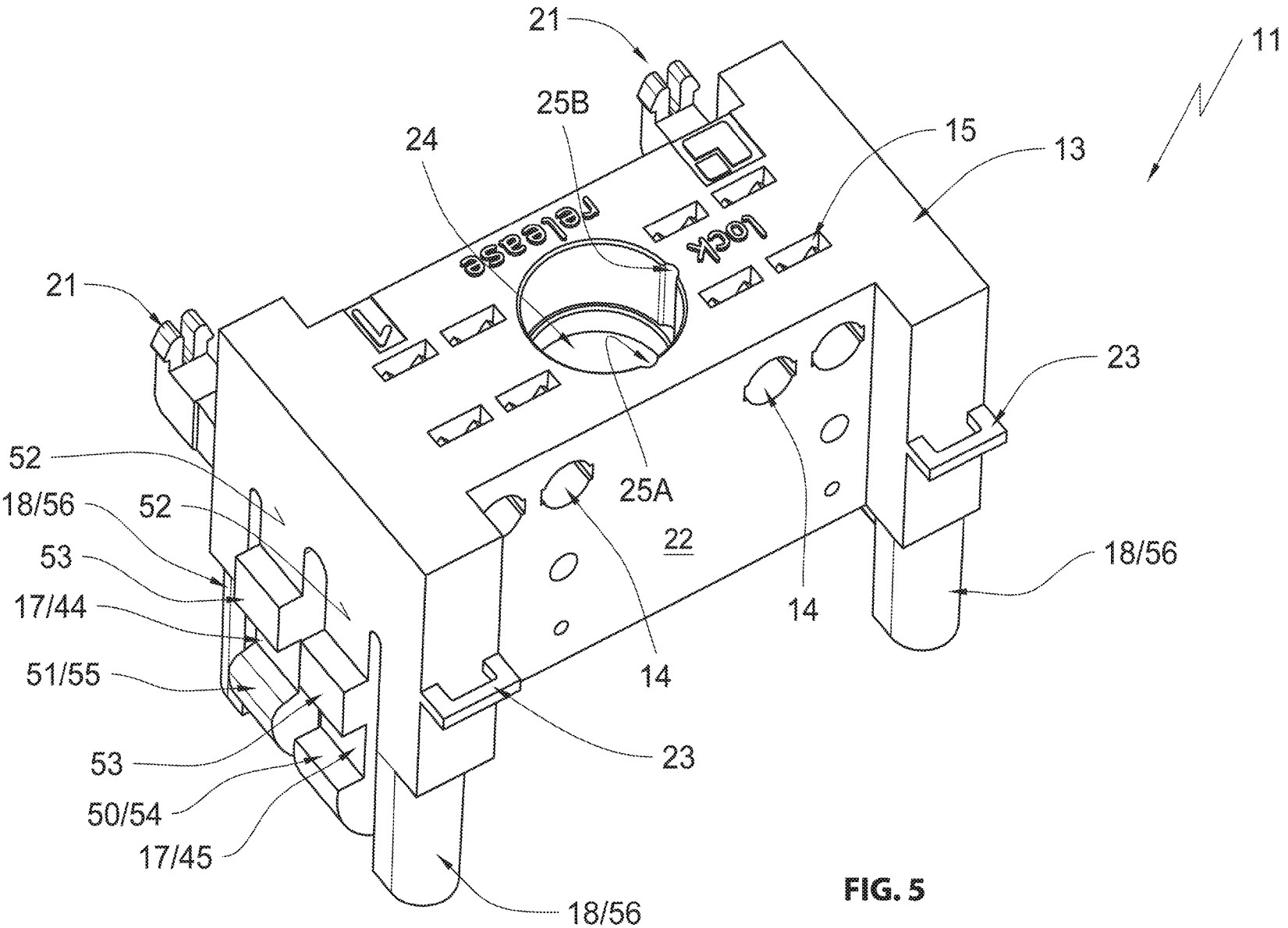
FIG. 5 illustrates a perspective view of the contact carrier of the plug connector according to FIG. 1 from above.
Figure 6:
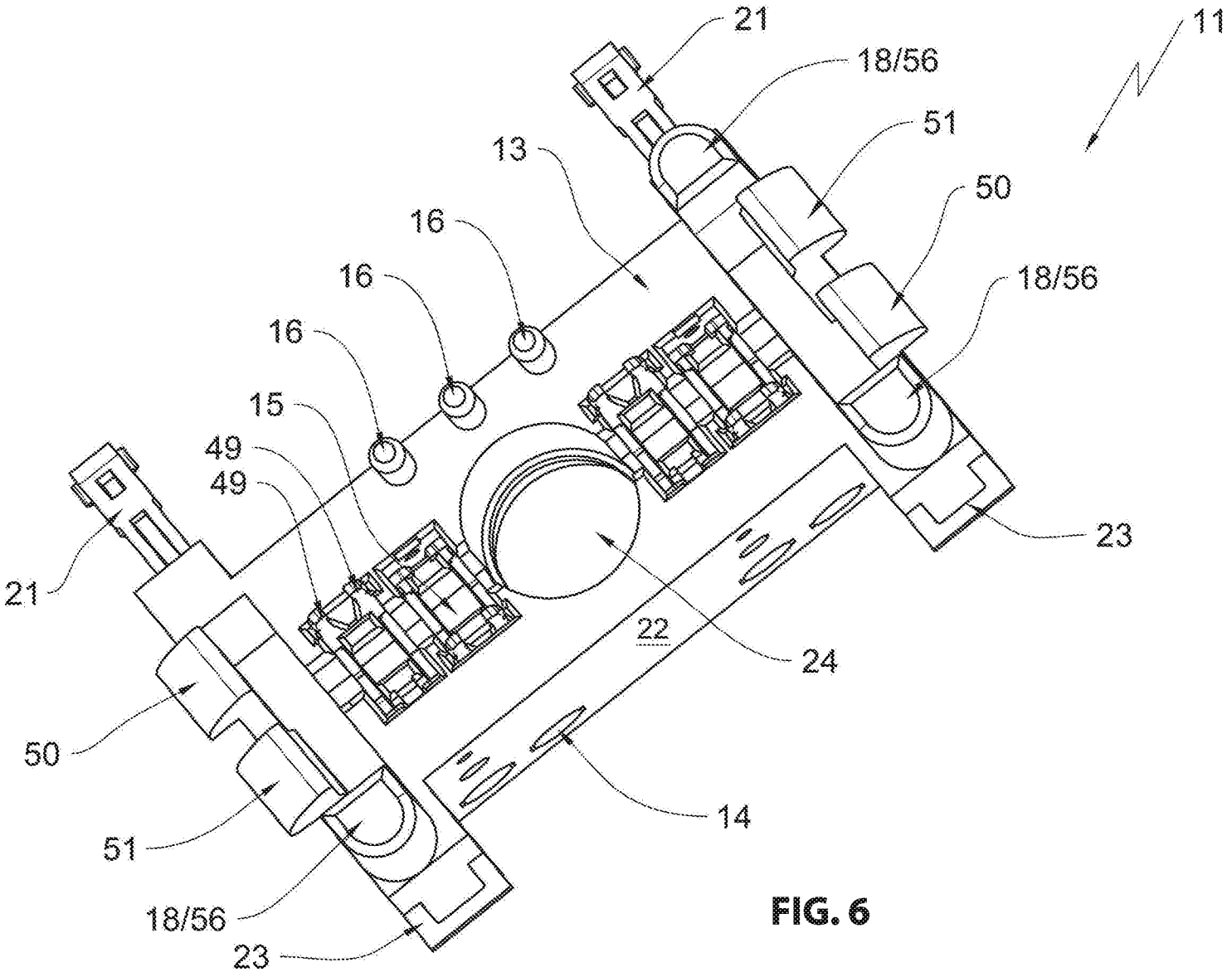
FIG. 6 illustrates a perspective view of the contact carrier according to FIG. 5 from below.
Figure 7:
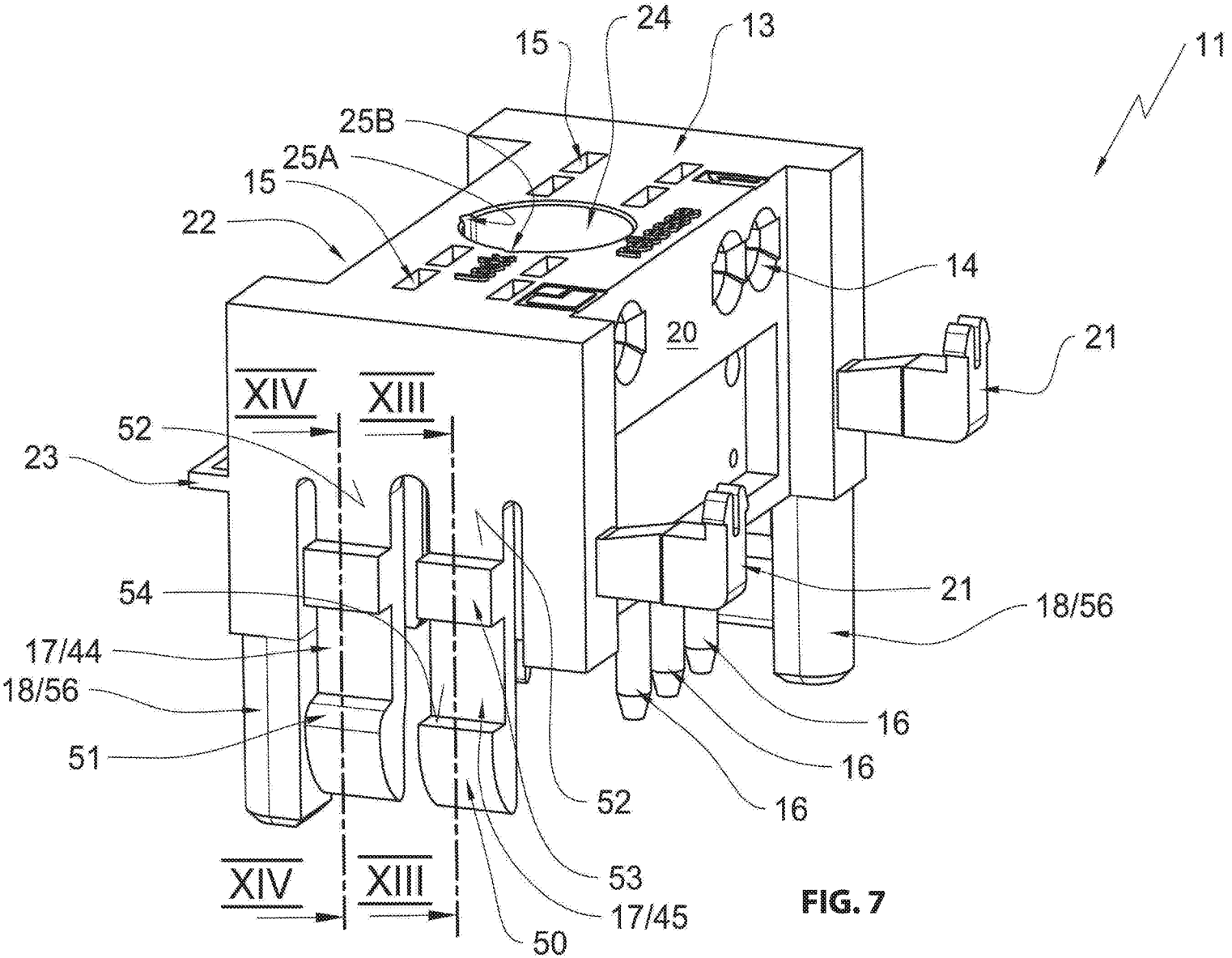
FIG. 7 illustrates a perspective side view of the contact carrier according to FIG. 5.

The primary safety 17 is illustrated, e.g., in FIGS. 5 through 7 and facilitates arranging the contact carrier 11 at the circuit board 19. The primary safety 17 is formed by two interlocking arm pairs, Each interlocking arm pair includes a first interlocking arm 44 and a second interlocking arm 45. The interlocking arms 44, 45 respectively originate from an interlocking arm base 52 that is respectively oriented away from the free end, wherein the interlocking arm base 52 is arranged at the contact carrier 11. The interlocking arms 44, 45 respectively include a disengagement cam 53 which facilitates a backward displacement of the interlocking arms 44, 45 into a disengagement position in order to separate the plug connector 10 from the circuit board 19 when a corresponding pressure is applied, wherein the disengagement cams 53 form an optional non-mandatory feature of the interlocking arms 44, 45.

The interlocking arms 44, 45 include locking devices 50, 51 at their free ends wherein the locking devices include various interlocking surfaces 54 and 55.

Figure 8:
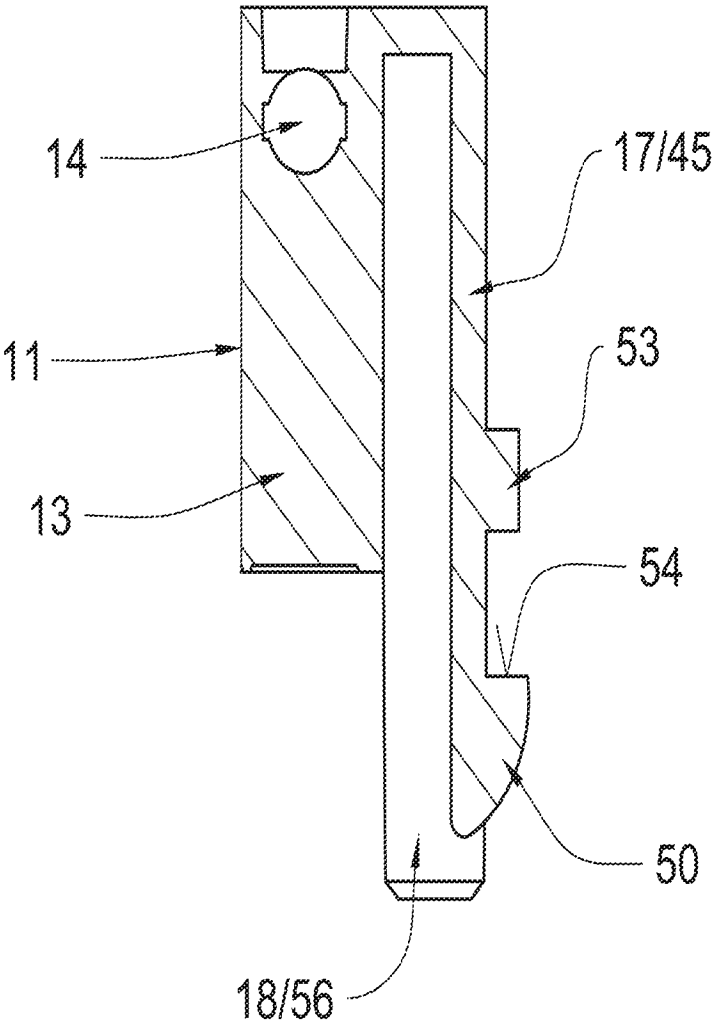
FIG. 8 illustrates a sectional view of a first interlocking arm of a primary interlocking of the plug connector according to FIG. 1 along the sectional plane XIII-XIII according to FIG. 7.

FIG. 8 illustrates the first interlocking device 50 of the second interlocking arm 45. The first interlocking device 50 of the second interlocking arm 45 forms an interlocking surface 54 that reaches under the circuit board 19. The interlocking surface 54 is essentially configured orthogonal relative to the plug in direction of the plug connector, thus approximately parallel to the bottom side 46 of the circuit board 19 as evident in, e.g., from FIGS. 11 and 13. Thus, the plus connector 10 is secured against a pull force that can be applied, e.g., by the non-illustrated connecting conductors. The interlocking surface 54 of the first interlocking device 50 facilitates a retaining force of up to 60 Newton.

Figure 9:
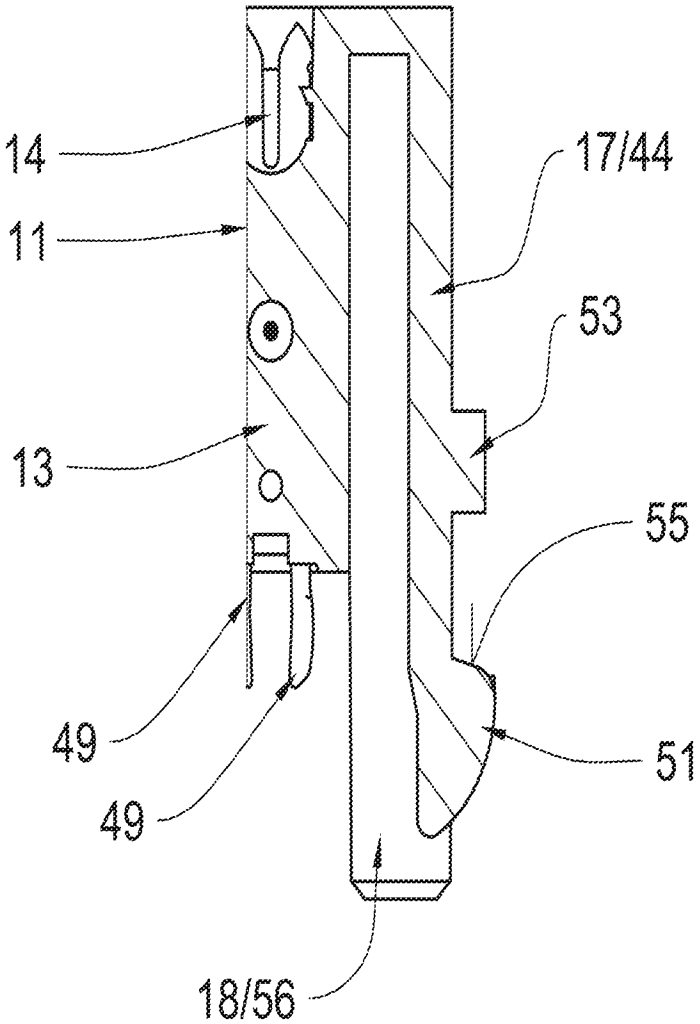
FIG. 9 illustrates a sectional view of a second interlocking arm of a primary interlocking of the plug connector according to FIG. 1 along the sectional plane XIV-XIV according to FIG. 7.

FIG. 9 illustrates the second interlocking device 51 of the interlocking arm 44. The second interlocking device 51 of the interlocking arm 44 includes an interlocking surface 55 which is configured downward sloping from the first interlocking arm 44 in the plug-in direction.

The interlocking surface 55 helps to compensate tolerances between the contact carrier 11 and the circuit board 19. The interlocking arms 44 that are arranged at the circuit board are illustrated, e.g., in FIGS. 11 and 13. The downward sloping interlocking surface 55 reaches under circuit boards 19 with minimum thickness completely so that the surface origin that is arranged proximal to the first interlocking arm 44 provides support at the circuit board 19 for the plug connector 10 in addition to the interlocking surface 54. The downward sloping interlocking surface 55 only reaches under circuit boards 19 with a maximum thickness at an end of the downward sloping interlocking surface 55 that is oriented away from the origin and which provides support for the plug connector 10 in addition to the interlocking surface 54. Depending on an intermediate thickness of the circuit board 19 the interlocking surface 55 reaches under the circuit board 19 partially.

In a particularly advantageous embodiment the downward sloping interlocking surface 55 encloses an angle of 20° with a bottom side 46 of the circuit board 19 and facilitates a tolerance compensation of up to 10% of a nominal thickness of the circuit board 19. Also the downward sloping interlocking surface 55 helps to anchor the plug connector 10 at the circuit board 19. A tension force that is compensable by the downward sloping interlocking surface 55, however, is small.

Figure 11:
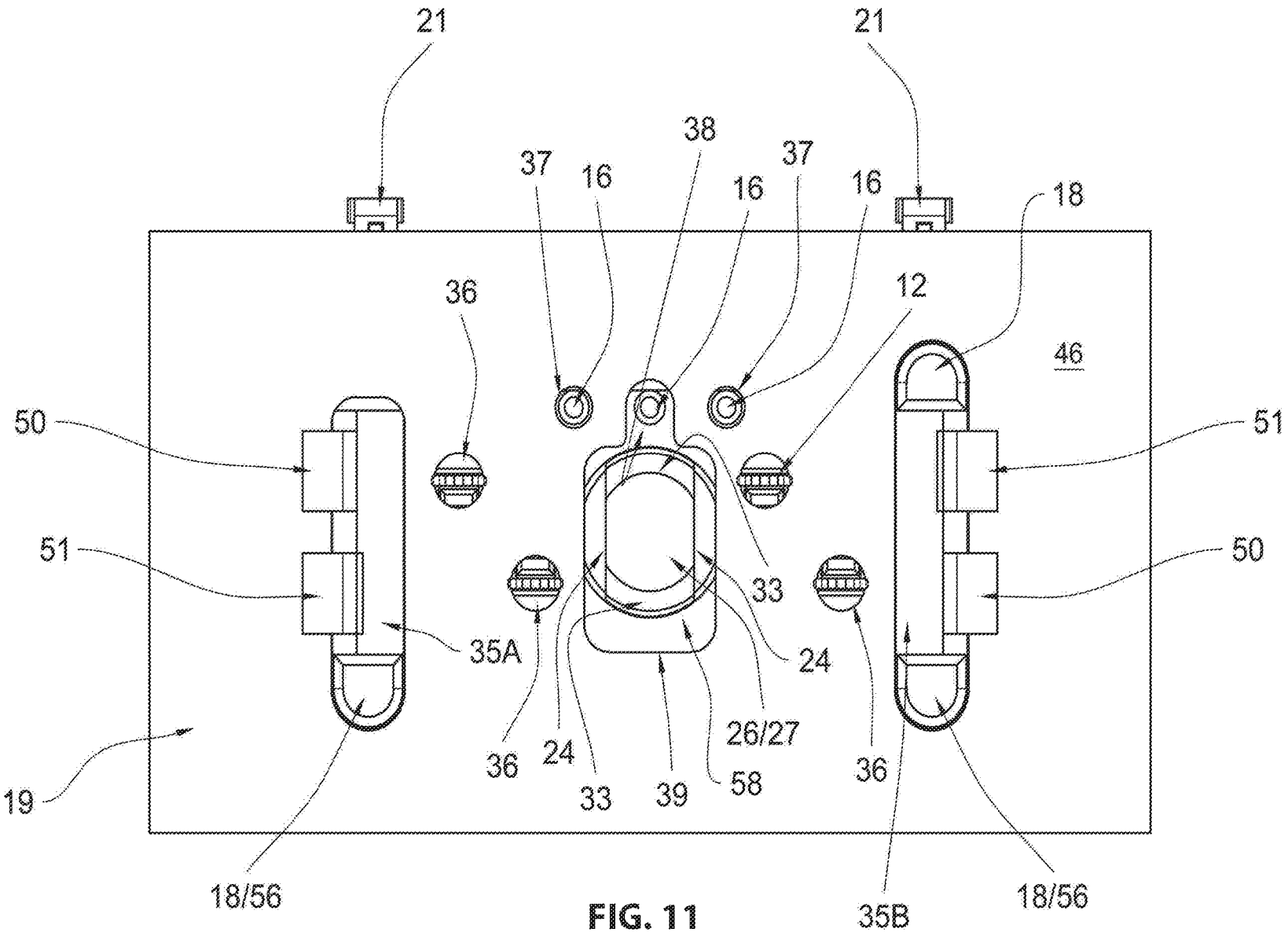
FIG. 11 illustrates a bottom view of the circuit board according to FIG. 4 with the arranged plug connector according to FIG. 1 and the locking pin in unlocking position.

The interlocking arms 44, 45 precede the contact carrier 11 and are arranged parallel with each other. The plug connector 10 includes two interlocking arm pairs that are arranged at opposite sides of the plug connector 10. The interlocking devices 50 and 51 with identical interlocking geometry are arranged diagonally opposite to each other at the contact carrier 11. FIG. 11 illustrates that the interlocking device 51 of the interlocking arm pair that is arranged on the left side with respect to the paper plane is arranged in front, the interlocking device 50, however, is arranged in the back. The interlocking arm pair that is on the right side with respect to the paper plane, however, includes an interlocking device 50 that is arranged in front, whereas the interlocking device 51 is arranged in the back. This way the recited diagonal arrangement is achieved.

Through the diagonally opposed interlocking devices 50 and 51 with identical configuration of their interlocking surfaces 54 and 55, a tilting of the plug connector 19 under tension is prevented and thus the contact spot loading between the plug contacts 12 and the contact holes 36 is rendered more uniform.

Figure 10:
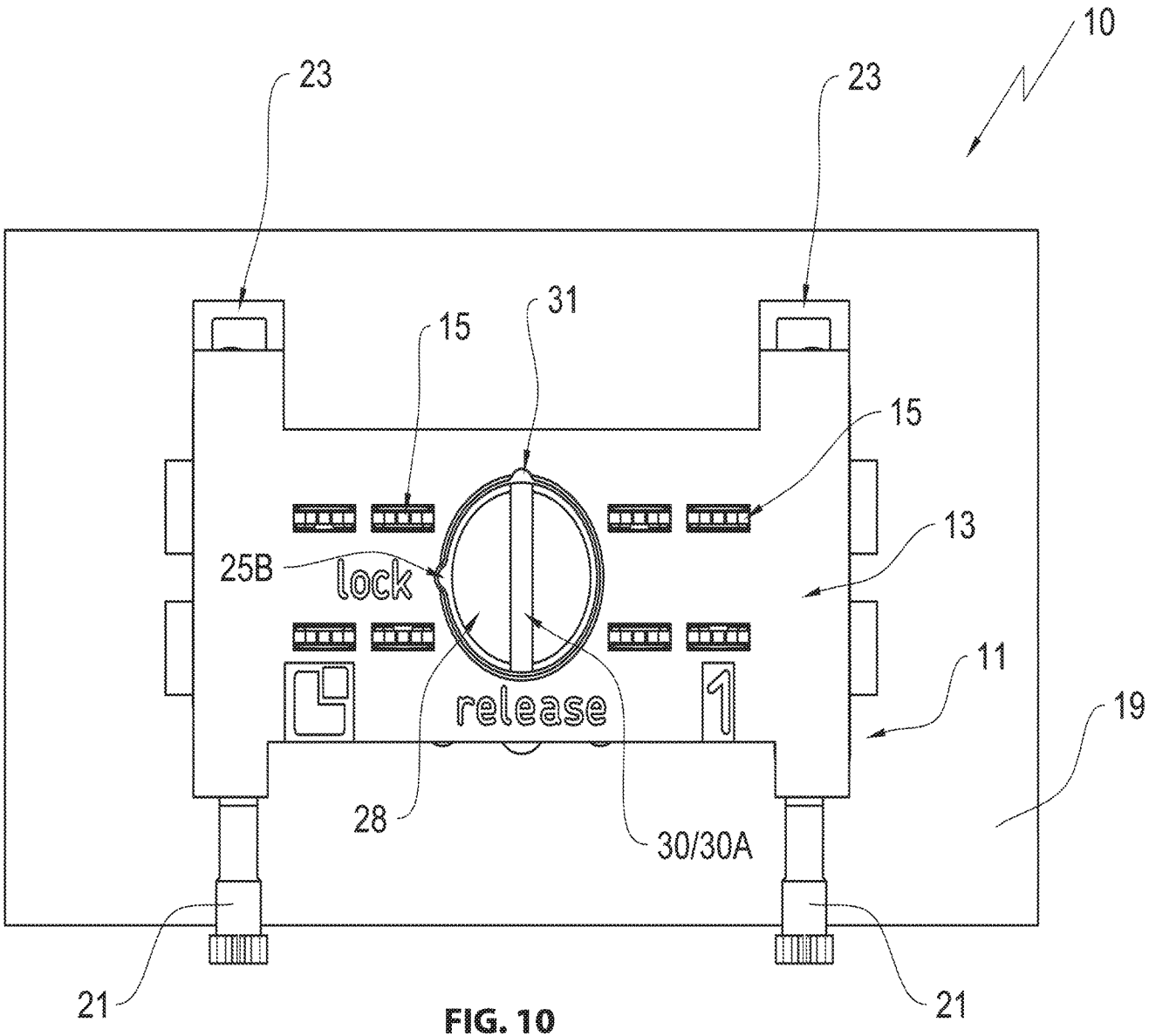
FIG. 10 illustrates the view of the plug connector according to FIG. 1 from above, wherein the plug connector contacts the circuit board according to FIG. 4.

In FIGS. 10 and 11 the secondary safety 26 is stored in the unlocking position and illustrated in top view in FIG. 10 and in a bottom view in FIG. 11. The unlocking position is indicated by the groove 30A pointing towards the word "Release". Another type of optical display is possible. In the unlocking position the rib 31 of the head portion 28 of the locking pin 27 cooperates with the first notch 25A that is associated with the term "Release". In this position the rib 31 and the first notch 25A support the locking pin 27 in the unlocking position. An independent rotation of the locking pin 27 or by vibration is not possible. The secondary safety 26, however, is only supported in the stem section 58 of the cutout 39 so that the locking protrusions 33 of the locking pin 27 do not reach under the circuit board 19.

Figure 12:
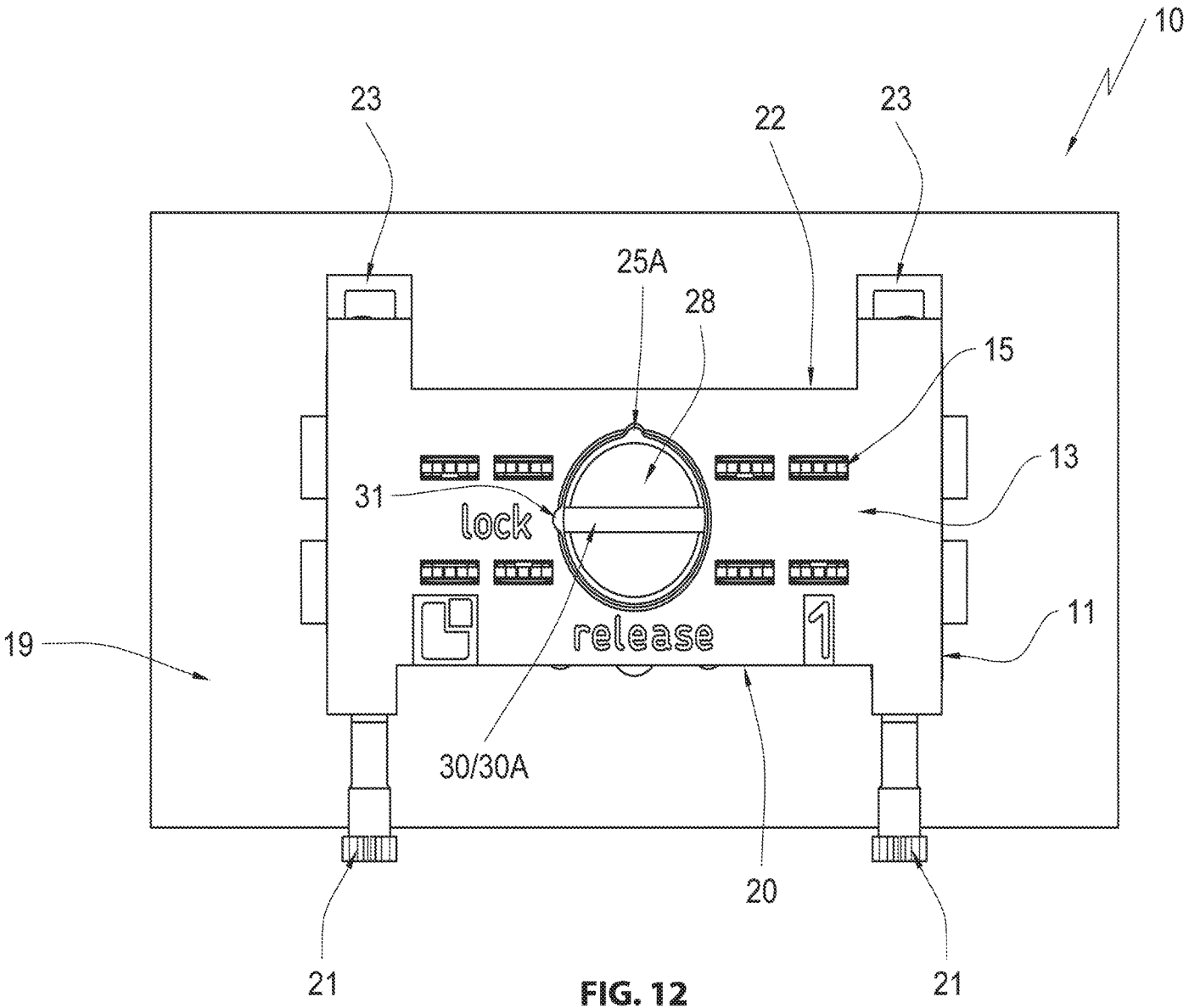
FIG. 12 illustrates a view of the plug connector arranged on the conductor arranged on the circuit board according to FIG. 4 with the locking pin in locking position according to FIG. 1.
Figure 13:
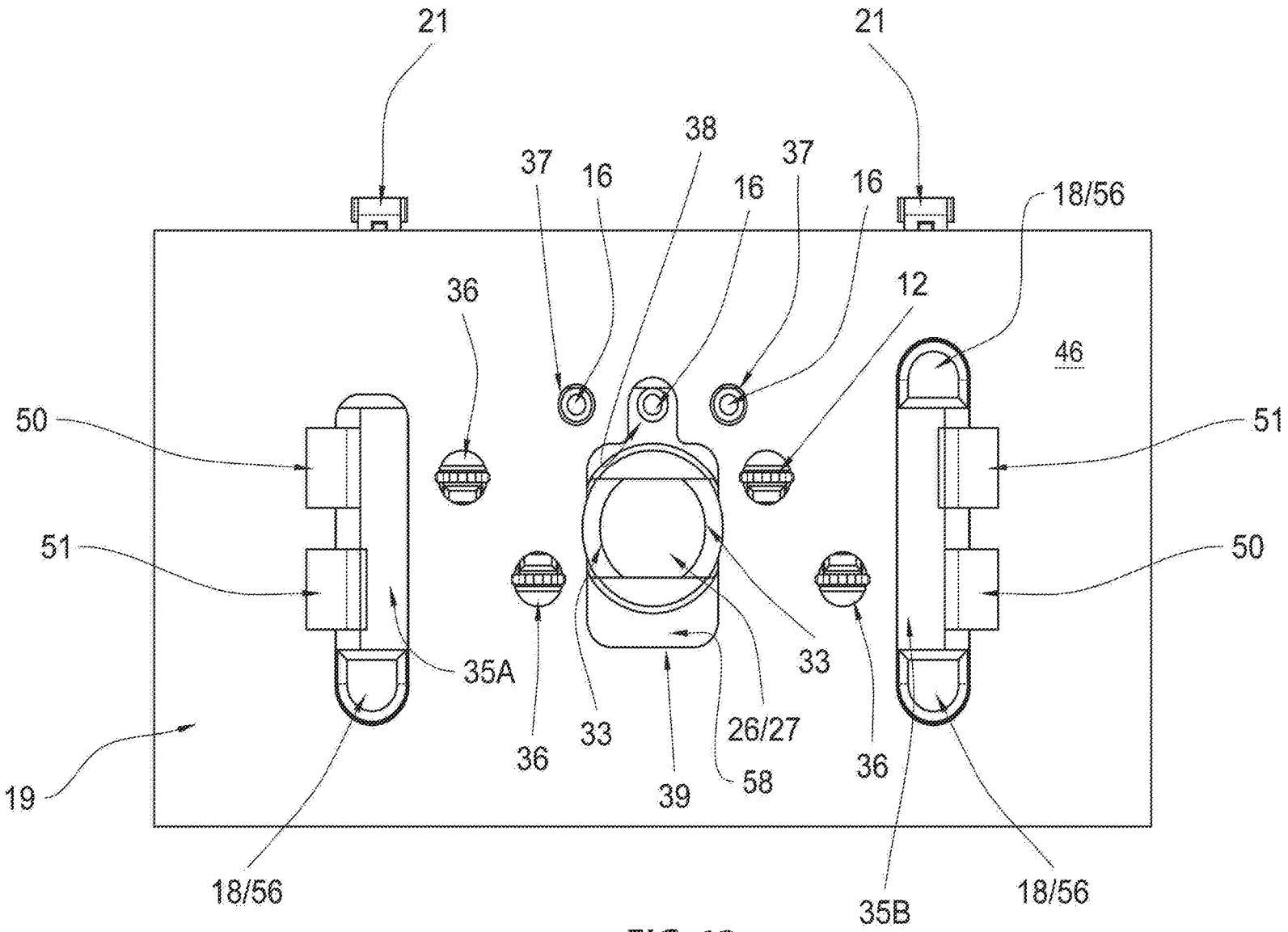
FIG. 13 illustrates a bottom view of the circuit board according to FIG. 4 with arranged plug connectors according to FIG. 1 and the locking pin in the locking position.
Figure 14:
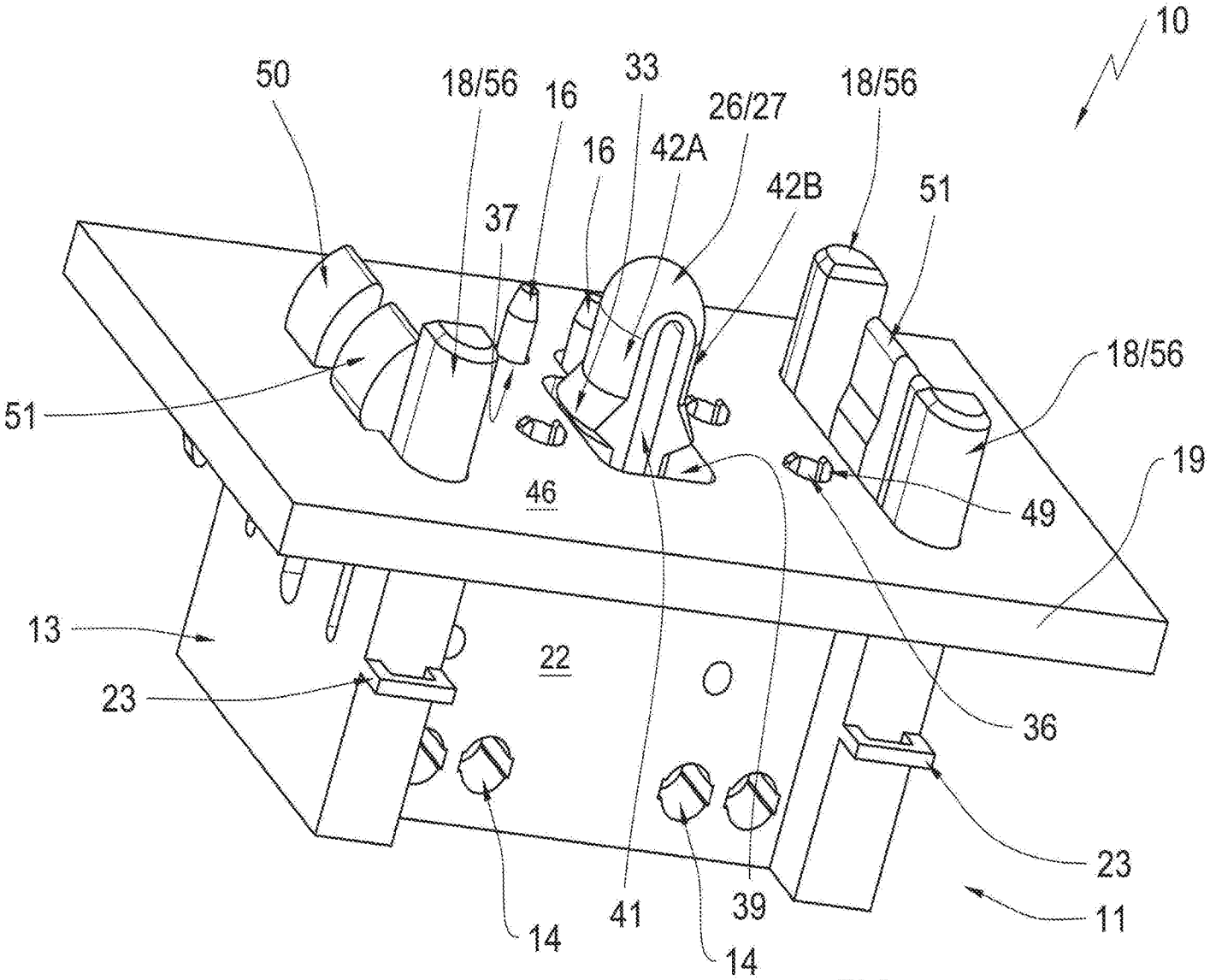
FIG. 14 illustrates a perspective bottom view of the plug connector according to FIG. 1 arranged on the circuit board with the locking pin in locking position.

In FIGS. 12 through 14 the locking pin 27 is moved into the locking position. The rotatably supported locking pin 27 facilitates clamping the contact carrier 11 with the circuit board 19 in that the locking pin 27 is rotated from the unlocking position into the locking position with the plug connector 10 mounted to the circuit board 19. The locking pin 27 is supported in the stem portion 58 of the pass-through opening 39 in the locking position so that the locking bar protrusions 33 of the locking pin 27 reach under the circuit board 19 and clamp the contact carrier 11 with the circuit board 19 through the thread section configuration of the locking bar protrusions 33.

Alternatively the locking pin 27 can already be arranged in the locking position when placed on the circuit board 19. Then the locking protrusions 33 run onto the edge of the pass-through opening 39. The slot 41 that is vertically arranged in the locking pin 27 facilitates an elastic backward movement of the locking protrusions 33 of the locking pin 27 when the locking pin 27 is moved forward so that the locking protrusions 33 penetrate the pass-through opening 39 and reach under the circuit board 19.

In the locking position of the locking pin 27, the rib 31 of the head portion 28 of the locking pin 27 cooperates with the second notch 25B of the borehole 24. The locking position is identified by the word "Lock". The groove 30A includes the word "Lock". The plug connector 10 is safely mounted at the circuit board 19.

FIGS. 15 through 18 disclose a second embedment of the plug connector 10. In addition to the recited components of the plug connector 10 according to the first embodiment, the plug connector 10 includes a safety hood 60.

Figure 15:
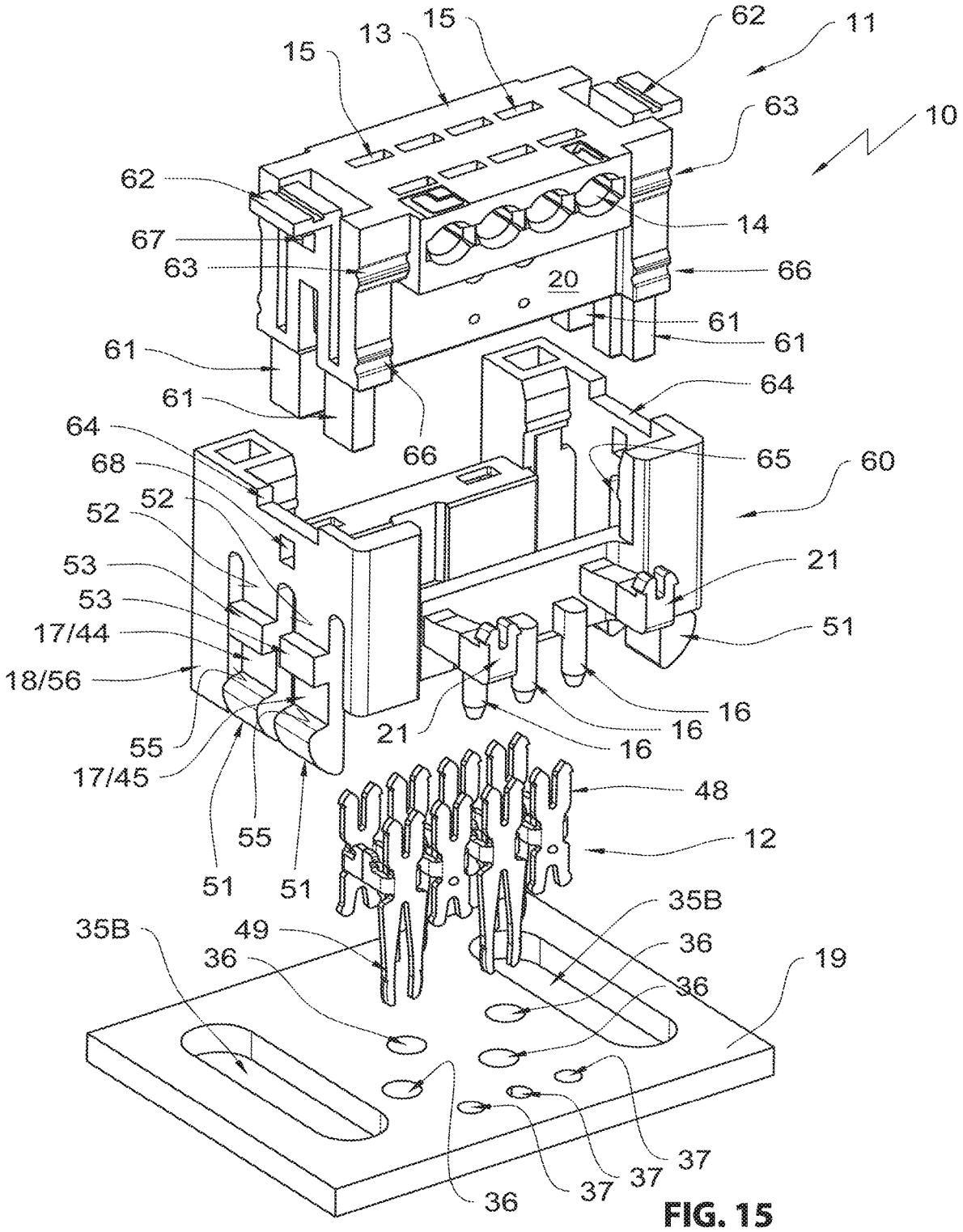
FIG. 15 illustrates the exploded view of a second embodiment of the plug connector.

FIG. 15 illustrates the circuit board 19 in addition to the plug connector 10 with the contact carrier 11 and the safety hood 60.

The safety hood 60 circumferentially envelopes the contact carrier 11 wherein the contact carrier 11 is movably arranged in the safety hood 60. The contact carrier 11 includes locking pins 61 that are oriented parallel to the plug-in direction wherein the locking pins 61 preceded the contact carrier 11 and position the contact carrier 11 in the safety hood 60 in preassembly condition.

Additionally the contact carrier 11 forms interlocking profiles 63 and interlocking grooves 66 which precede the contact carrier 11 in the plug-in direction and cooperate with interlocking bars 65 of the safety hood 60 according to the preassembled condition and assembled condition of the contact carrier 11 in the safety hood 60.

Figure 16:
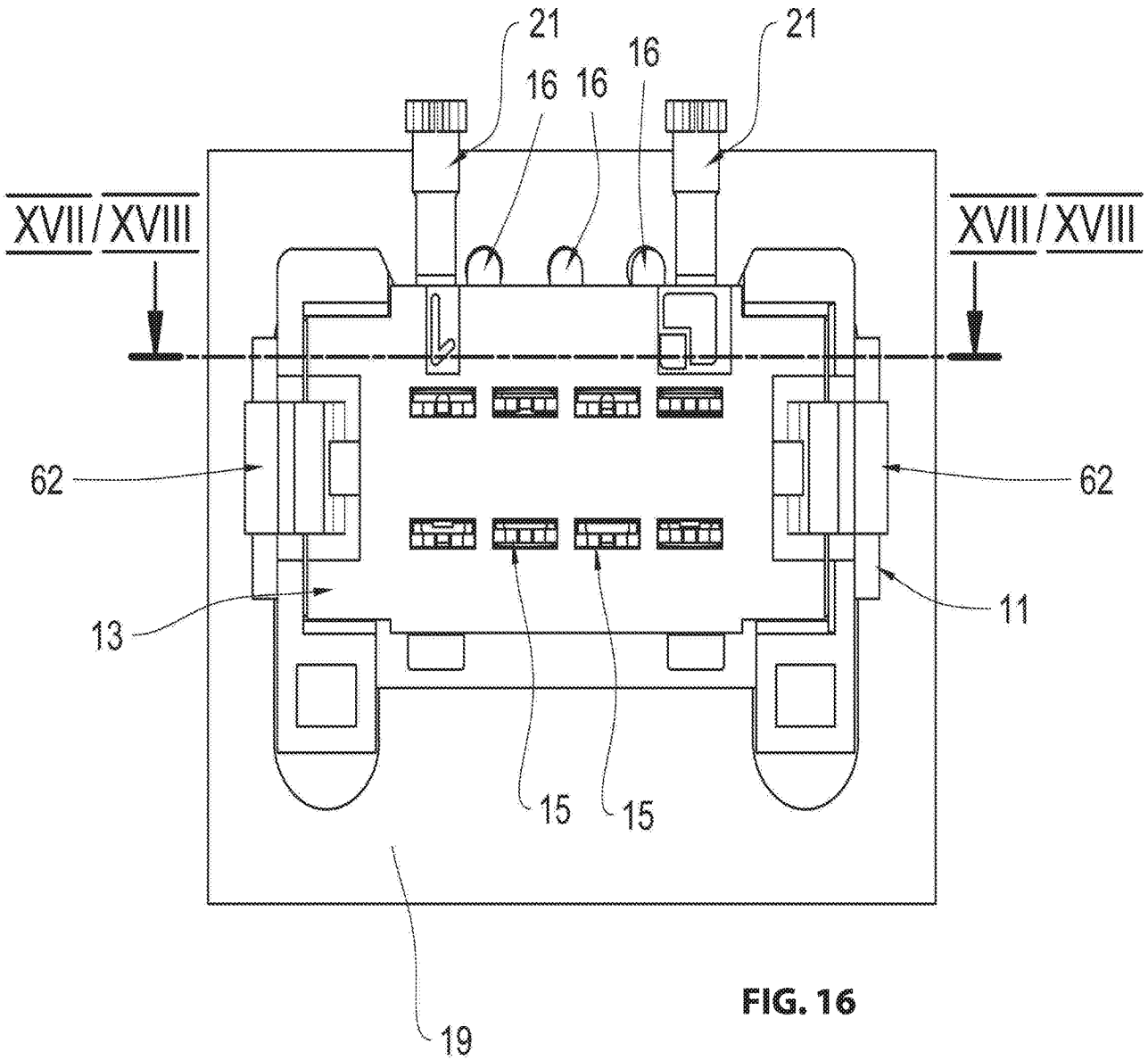
FIG. 16 illustrates a top view of the plug connector according to FIG. 15.

Furthermore, the contact carrier 11 includes interlocking lobes 62 which originate from the housing 13 at short sides of the contact carrier 11. The interlocking lobes 62 are configured reset elastic and cooperate with interlocking openings 64 that are formed by the safety hood 60 as illustrated in FIG. 16. Through cooperation of the interlocking lobes 62 and the interlocking openings 64, the contact carrier 11 is interlocked at the safety hood 60. Through pressure the interlocking lobes 62 can be moved back so that the contact carrier 11 can be disengaged from the safety hood 60.

Additionally the interlocking lobe 62 forms an interlocking lug 67 which cooperates with a corresponding interlocking recess 68 that is formed by the safety hood 60. As soon as the contact carrier 11 is moved into the mounting position the interlocking lug 67 cooperates with the interlocking recess 68 as illustrated in the sectional view in FIG. 17. The interlocking lug 67 penetrates the interlocking recess 68 and thus additionally fixes the contact carrier 11 in the safety hood 60, Moving the interlocking lobe 62 back also moves back the interlocking lug 67 so that the contact carrier 11 can be disengaged from the safety hood 60.

Contrary to the first embodiment of the plug connector 10, the primary safety 17, the polarity safety 18 and the coding pins 16 of the safety hood 60 do not originate from the contact carrier 11, The primary safety 17 includes locking arm pairs 44 in this second embodiment of the plug connector 10 wherein the locking arm pairs are identical on both sides and configured together with the locking devices 51. The interlocking devices 51 include interlocking surfaces 55 which provide tolerance compensation between the contact carrier 11 and the circuit board 19.

However, it is also conceivable that the primary safety 17 is configured identical with the first embodiment of the plug connector 10 as illustrated, e.g., in FIG. 5.

Also, the polarity safety 18 can be configured according to the first embodiment of the plug connector 10 as can be derived from an exemplary manner from FIG. 6.

In order to attach the plug connector 10 at the circuit board 19, the contact fingers 49 of the plug contacts 12 have to be received in the contact openings 36 of the circuit board in order to provide electrical contacting.

The contact carrier 11 is positioned in the safety hood 60 by locking pins 61, wherein the locking grooves 66 of the contact carrier 11 cooperate in the preassembly position with the interlocking bars 65 of the safety hood 60. The plug contacts 12 are inserted in the contact recesses 15 of the contact carrier 11. Since the contact carrier 11 and accordingly also the plug contacts 12 are provided in the preassembly condition offset from the circuit board 19 an electrical contacting of the plug connector 10 with the circuit board 19 is excluded in the preassembly position of the plug connector 10.

In order to finish assembling the plug connector 10 the contact carrier 11 is moved in the plug-in direction and thus displaced into the assembly position. The interlocking bars 66 now engage the interlocking profiles 63 of the contact carrier 11 and arrange the contact carrier 11 in the safety hood 60. Additionally, the interlocking lobes 62 interlock at the interlocking openings 64 of the safety hood 60. Displacing the contact carrier 11 in the plug-in direction also displaces the plug contacts 12 in the plug-in direction in addition to the coding pins 16 which penetrate the coding boreholes 37 of the circuit board 19, Thus, the contact pins 49 of the plug contacts 12 cooperate with the contact openings 36 in the circuit board 19 and thus facilitate electrical contacting.

Figure 17:
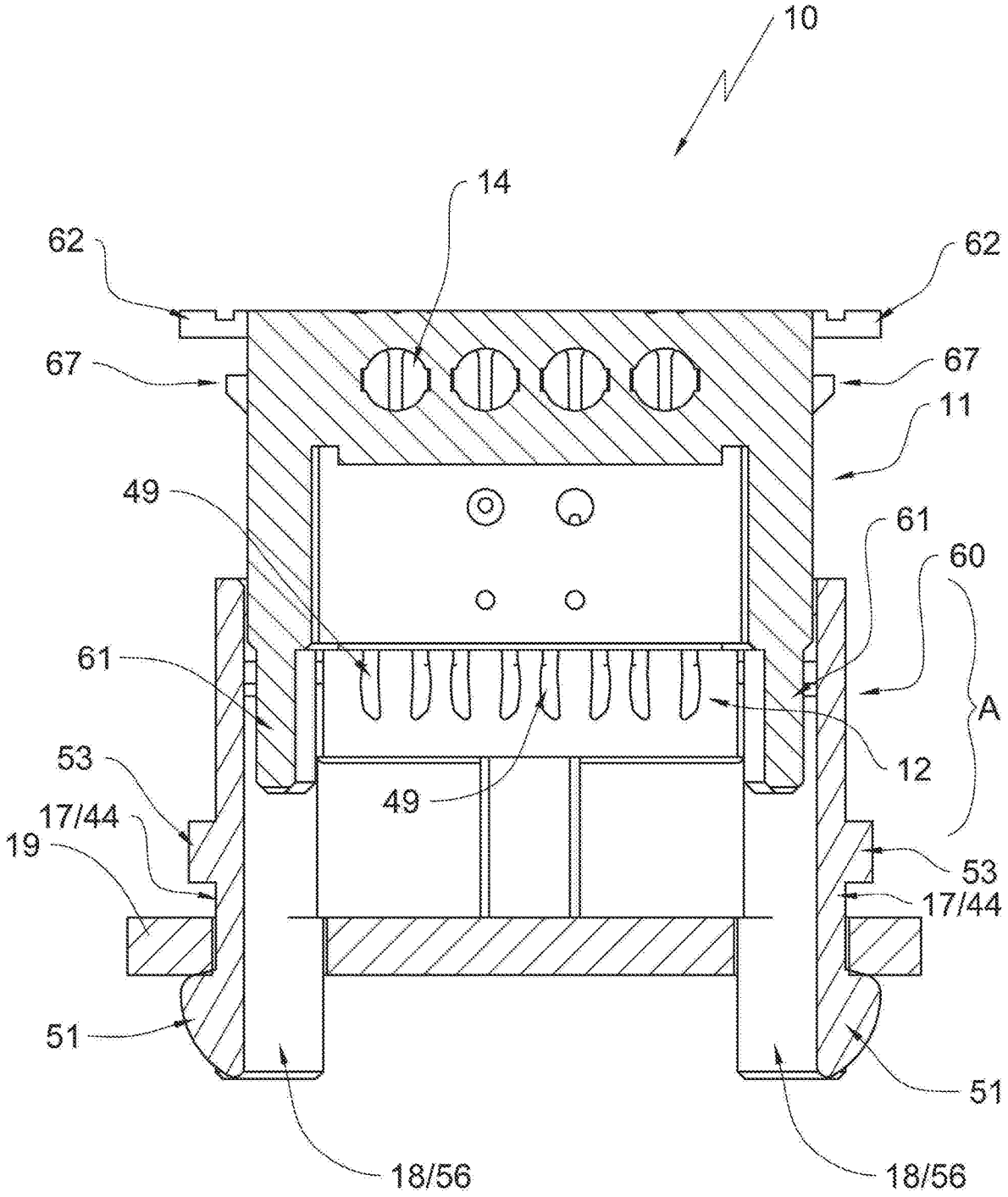
FIG. 17 illustrates a sectional view of the plug connector according to FIG. 15 along the sectional plane XVII-XVII according to FIG. 16 with the contact carrier in a preassembled position.

FIG. 17 illustrates the plug connector 10 at the circuit board 19 in the preassembly position.

In FIG. 17 the safety hood 60 of the circuit board 19 is mounted. The interlocking surfaces 55 of the interlocking arms 44 reach below the circuit board 19 and fix the safety hood 60 at the circuit board 19.

The contact carrier 11 is arranged in the safety hood 60 in the preassembly condition. The interlocking pins 61 of the contact carrier 11 are arranged in an upper portion A above the interlocking arms 44. Thus, a movement space that is required for a disengaging backward movement of the interlocking arms is provided. The interlocking arms 44 can be moved backward into the moving space by pressure on the disengagement cams 53 so that the safety hood 60 can be disengaged from the circuit board 19 easily.

Figure 18:
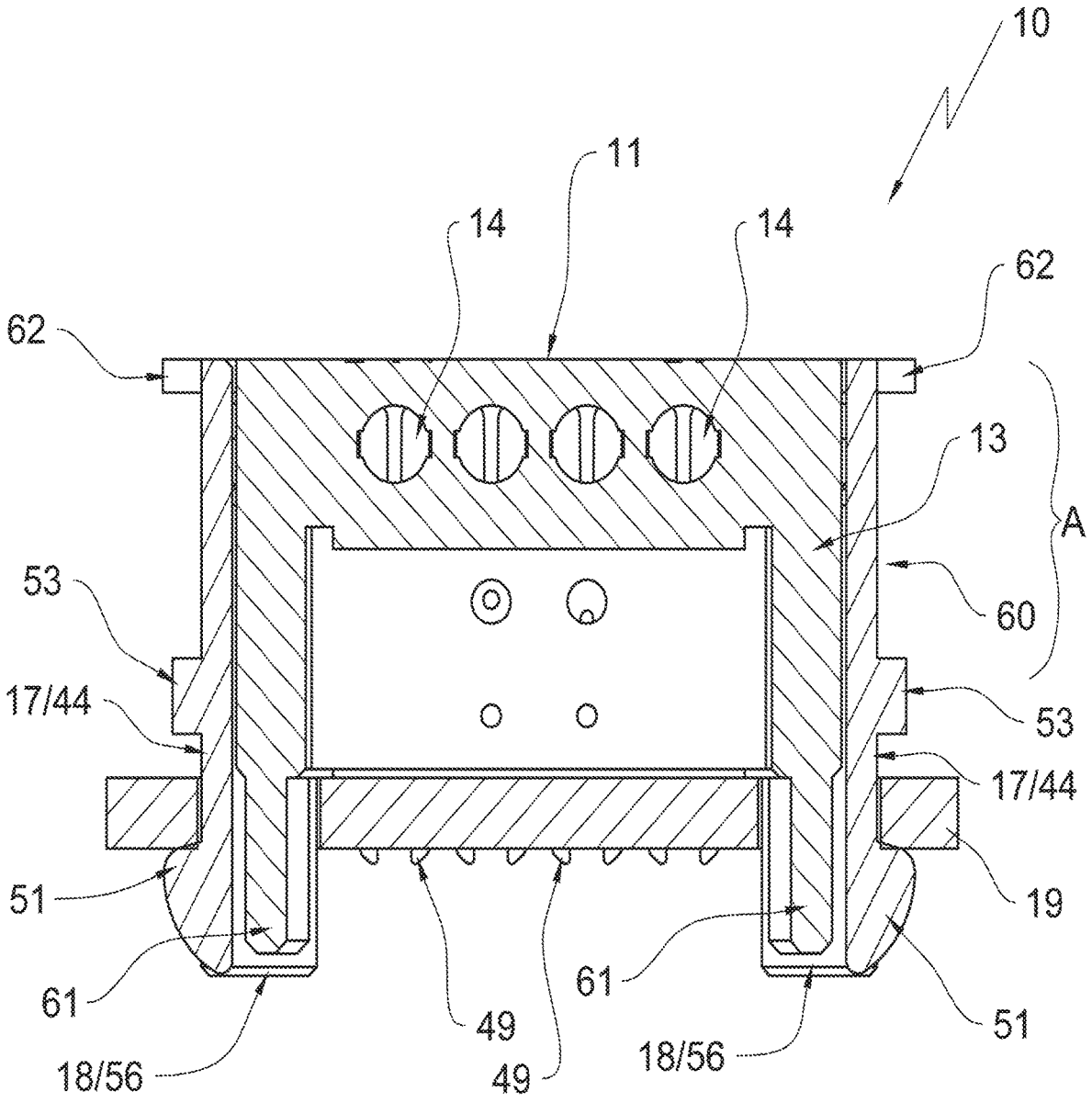
FIG. 18 illustrates the sectional view of the plug connector according to FIG. 15 along the sectional plane XVIII-XVIII according to FIG. 16 with the contact carrier in the assembled position.

When the contact carrier 11 is moved in the safety hood 60 into the assembly position as illustrated in FIG. 18, the interlocking pins 61 are moved in the plug-in direction and penetrate into the recited movement space and thus block the disengaging backward movement of the interlocking arms 44. Due to the blockage it is impossible now to disengage the plug connector 10 from the circuit board 19. Thus, safe and reliable contacting is provided.

REFERENCE NUMERALS AND DESIGNATIONS

10 Plug connector
11 Contact carrier
12 Plug contact
13 Housing
14 Conductor insert channel
15 Contact recess
16 Coding pin
17 Primary safety
18 Polarity safety
19 Circuit board
20 Front side
21 Interlocking hook
22 Backside
23 Contour for receiving 21
24 Borehole
25A First notch
25B Second notch
26 Secondary safety
27 Interlocking pin
28 Head portion
29 Base element
30 Tool engagement surface
30A Groove
31 Rib
33 Interlocking bar protrusion
35A First slotted hole
35B Second slotted hole
36 Contact opening
37 Coding borehole
38 Web section
39 Pass-through opening
40A First side wall of 29
40B Second side wall of 29
41 Slot
42A Side A of 24
42B Side B of 24
44 First interlocking arm
45 Second interlocking arm
46 Bottom side of 19
47 Assembly locking protrusion
48 Cutting Clamping fork
49 Contact finger
50 First interlocking device
51 Second interlocking device
52 Interlocking arm base
53 Disengagement cam
54 First interlocking surface
55 Second interlocking surface
56 Polarity protrusion
58 Stem section
60 Safety hood
61 Locking pin
62 Interlocking lobe
63 Interlocking profile
64 Interlocking opening
65 Interlocking bar
66 Interlocking groove
67 Interlocking lug
68 Interlocking recess
A Upper portion of interlocking arm 44
IIb Detail circle

What is claimed is:

1. A direct plug connector configured to contact contact openings of a circuit board, the direct plug connector comprising:

a contact carrier which includes coding devices configured as coding pins and a polarity reversal safety configured as at least one polarity protrusion:

conductor insertion channels formed by the contact carrier and configured to receive connection conductors;

contact recesses configured to receive plug contacts;

a primary safety that supports the contact carrier at the circuit board and that is configured by interlocking elements integrally formed in one piece with the contact carrier that interlock the contact carrier at the circuit board and are self-acting when the contact carrier is pressed onto the circuit board in an insertion direction to provide an interlocked contact carrier and that prevent an extraction of the interlocked contact carrier from the circuit board through direct form locking with the circuit board when the contact carrier is pulled away from the circuit board against the insertion direction, wherein the contact carrier is provided with a secondary safety which fixes the contact carrier at the circuit board in addition to the primary safety and which is operable independently from the primary safety, wherein the secondary safety is a locking pin that is integrally provided in one piece, separate from the contact carrier and separate from the primary safety and mountable at the contact carrier, wherein the locking pin is prelocked in a mounting position at the contact carrier so that the locking pin is secured against separation from the contact carrier without engaging the circuit board, and wherein the contact carrier is terminally locked at the circuit board in a functional position that fixes the contact carrier at the circuit board and that prevents an extraction of the contact carrier from the circuit board against the insertion direction of the contact carrier into the circuit board through direct form locking between the locking pin and the circuit board.

2. The direct plug connector according to claim 1, wherein the locking pin is rotatably arranged in a borehole that penetrates the contact carrier and that is parallel to an insertion direction of the contact carrier.

3. The direct plug connector according to claim 1, wherein the locking pin is provided with a first interlocking geometry which facilitates reassembly and a second interlocking geometry which cooperates with the circuit board to fix the contact carrier at the circuit board.

4. The direct plug connector according to claim 3, wherein the locking pin is rotate arranged in a borehole that penetrates the contact carrier and that is parallel to an insertion direction of the contact carrier, and wherein the second locking geometry envelopes a portion of an outer circumference of the locking pin.

5. The direct plug connector according to claim 1, wherein the locking pin is movable into a locking position and into an unlocking position, wherein the locking pin fixes the contact carrier at the circuit board in the locking position, and wherein a fixing effect of the locking pin is released in the unlocking position.

6. The direct plug connector according to claim 5, wherein the locking pin is rotatably arranged in a borehole that penetrates the contact carrier and that is parallel to an insertion direction of the contact carrier, wherein the second locking geometry envelopes a portion of an outer circumference of the locking pin, and wherein a rotation by 90° moves the locking pin (27) from its locking position into its unlocking position.

7. A direct plug connector configured to contact contact openings of a circuit board, the direct plug connector comprising:

a contact carrier which includes coding devices configured as coding pins and a polarity reversal safety configured at least one polarity protrusion;

conductor insertion channels formed by the contact carrier and configured to receive connection conductors;

contact recesses configured to receive plug contacts:

a primary safety that supports the contact carrier at the circuit board and that is configured by interlocking elements, wherein the contact carrier is provided with a secondary safety which fixes the contact carrier at the circuit board in addition to the primary safety and which is operable independently from the primary safety, wherein the secondary safety is a locking pin that is separately mountable at the contact carrier, wherein the locking pin is prelocked in a mounting position at the contact carrier and terminally locked at the circuit board in a functional position that fixes the contact carrier at the circuit board, wherein the locking pin is provided with a first interlocking geometry which facilitates reassembly and a second interlocking geometry which cooperates with the circuit board to fix the contact carder at the circuit board, wherein the locking pin is rotatably arranged in a borehole that penetrates the contact carrier and that is parallel to an insertion direction of the contact carrier, and wherein the second locking geometry envelopes a portion of an outer circumference of the locking pin, and wherein the second interlocking geometry includes two interlocking bar protrusions that are diametrically opposed at the locking pin.

8. The direct plug connector according to claim 7, wherein the interlocking bar protrusions form thread sections.

* * * * *